US006750389B2

(12) United States Patent
Hagiwara et al.

(10) Patent No.: US 6,750,389 B2
(45) Date of Patent: Jun. 15, 2004

(54) MUSICAL PERFORMANCE CONTROL METHOD, MUSICAL PERFORMANCE CONTROL APPARATUS AND MUSICAL TONE GENERATING APPARATUS

(75) Inventors: Yutaka Hagiwara, Shizuoka (JP); Kenji Kamada, Shizuoka (JP); Masahiko Iwase, Shizuoka (JP); Hisamitsu Honda, Shizuoka (JP); Shinji Niitsuma, Shizuoka (JP); Toshinori Matsuda, Shizuoka (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 44 days.

(21) Appl. No.: 10/156,852

(22) Filed: May 30, 2002

(65) Prior Publication Data

US 2002/0178898 A1 Dec. 5, 2002

(30) Foreign Application Priority Data

May 31, 2001 (JP) ..... 2001-164989

(51) Int. Cl.[7] ..... G10H 1/10; G10H 7/00
(52) U.S. Cl. ..... 84/631
(58) Field of Search ..... 84/631, 644

(56) References Cited

U.S. PATENT DOCUMENTS

| | | | | | |
|---|---|---|---|---|---|
| 5,691,495 | A | * | 11/1997 | Fujimori | 84/618 |
| 6,096,963 | A | * | 8/2000 | Hirano | 84/659 |
| 6,380,473 | B2 | * | 4/2002 | Uehara | 84/609 |
| 2001/0007219 | A1 | * | 7/2001 | Uehara et al. | 84/609 |
| 2002/0092411 | A1 | * | 7/2002 | Shiiya | 84/609 |

FOREIGN PATENT DOCUMENTS

| | | |
|---|---|---|
| JP | 05-33798 | 5/1993 |
| JP | 06-059671 | 3/1994 |
| JP | 2694935 | 9/1997 |
| JP | 2000-352972 | 12/2000 |
| JP | 2000-352976 | 12/2000 |

* cited by examiner

*Primary Examiner*—Jeffrey Donels
(74) *Attorney, Agent, or Firm*—Oblon, Spivak, McClelland, Maier & Neustadt, P.C.

(57) ABSTRACT

When the performance by a piano part is automatically provided based on musical performance information so as to provide an ensemble performance with an automatic performance part by an electronic tone generator, a processing path for the automatic performance part on the side of the electronic tone generator includes a DSP to provided delayed output in the musical tone data so as to conform to a sound production timing of the piano part side.

11 Claims, 14 Drawing Sheets

MUSICAL PERFORMANCE CONTROL METHOD, MUSICAL PERFORMANCE CONTROL APPARATUS AND MUSICAL TONE GENERATING APPARATUS

CROSS-REFERENCE TO RELATED APPLICATIONS

The present application claims priorities under 35 U.S.C. §119 to Japanese Patent Application No. 2001-164989, filed on May 31, 2001 and entitled "MUSICAL PERFORMANCE CONTROL METHOD, MUSICAL PERFORMANCE CONTROL APPARATUS AND MUSICAL TONE GENERATING APPARATUS". The contents of the application are incorporated herein by reference in their entirety.

BACKGROUND OF THE INVENTION

1. Field of the Invention

The present invention relates to a musical performance control method, a musical performance control apparatus and a musical tone generating apparatus, which are applicable to provide an ensemble performance wherein a musical performance by an electronic tone generator and an automatic performance by a musical instrument are simultaneously provided.

2. Discussion of the Background

When an automatic piano player and an electronic tone generator are utilized to provide an ensemble performance in an automatic system, performance controls are carried out in the respective parts. To the piano performance part, musical performance information, such as key-in (event) information, is forwarded. In the electronic tone generator part, the musical performance information is forwarded as it is, and then the musical performance information is converted into such a state to be able to produce a musical tone based on data in the electronic tone generator (a state of musical tone data explained later) before being outputted.

In the automatic piano player, a musical performance is provided by striking a string with an electric and mechanical unit which moves a key, an action or a hammer in an actual piano by, e.g. a solenoid. As a result, there is a time lag between the timing when a string is struck to actually produce a musical tone since the musical performance information has been forwarded and the timing when the electronic tone generator part produces a musical tone. Even when the musical performance information has been transmitted to both of the automatic piano player and the electronic tone generator at the same timing, there has been created a problem that the production of a musical tone by the automatic piano player delays.

In order to solve the problem of the delay, it has been proposed in JP-A-5-33798 that the electronic tone generator part is provided with a delay buffer to avoid the occurrence of that sort of time lag by delaying the musical performance information to be forwarded to the part as shown in FIG. 19.

However, the inventor of the publication has pointed out the following problems of the proposal by the publication in Japanese Patent No. 2694935, which has been proposed as improvement to the proposal by the publication. He has pointed out the problems as follows: "By the way, this arrangement needs to include a storage dedicated to a delay buffer (300), and a control circuit and a processing program for controlling the storage in order to provide a delay of 500 msec. That is to say, the processing program executed by the controller (100) is divided into two systems, creating a problem that the arrangement becomes complicated. When the processor (the controller 100) outputs musical performance information having a high density, it becomes impossible to provide an ensemble performance in some cases because of insufficient storage capacity of the delay buffer (300). In other words, there is created a problem that the arrangement is poor at a reproduced musical performance."

The problems of JP-A-5-33798 pointed out in the Japanese Patent No. 2694935 are fatal problems, which are caused by storing musical performance information, such as a MIDI, into the buffer. The buffer for storing that sort of musical performance information is configured to include a buffer ring 600 shown in FIG. 20 for instance. The buffer 600 is configured in FIFO fashion (First In First Out). When musical performance information is inputted, the musical performance information is sequentially written in the buffer 600 according to increment of a write pointer 601. The musical performance information is sequentially read out from the buffer 600 according to increment of a read pointer 602 in the same direction. The pointers are called a ring buffer since each of the pointers return to a first address when having reached a last address. As stated earlier, when musical performance information having a high density is inputted in the arrangement, a proper ensemble performance has been impossible in some cases since the write pointer 601 overtakes the read pointer 602 to prevent the data to be read by the read pointer 602 from being correctly processed due to overwriting of data by the write pointer 601, or since when the ring buffer 600 is filled with data, further data are not acceptable until reading by the read pointer 602 proceeds to provide sufficient capacity. Even in the case without a ring buffer, an overflow is caused in some cases, depending on the capacity of a RAM.

The proposal by the Japanese Patent No. 2694935 needs to include a first reading unit and a second reading unit to provide automatic musical instruments having different sound production timings with control at different reading timings, creating a problem that the processing becomes complicated.

SUMMARY OF THE INVENTION

The present invention is proposed in consideration of the problems stated earlier. The invention provides a musical performance control method and a musical performance control apparatus capable of providing a proper ensemble performance with a musical performance by an electronic tone generator and an automatic performance by a musical instrument simultaneously provided even when musical performance information having a high density is inputted. The present invention also provides a musical tone generating apparatus capable of having a similar function.

The musical performance control method according to a first aspect of the present invention is characterized in that the method basically comprises providing a first automatic performance part based on musical performance information; providing a second automatic performance part as an ensemble performance; wherein the second automatic performance part is outputted as musical tone data with such a delay so as to conform to a sound production timing of the first automatic performance part.

The musical tone data according to the present invention are data that are in such a state to be able to produce a musical tone based on data outputted from an electronic tone generator or the like, i.e., in such a state that they can form an output waveform by D/A conversion so as to be outputted as they are (a state with an envelope or the like added thereto). The musical tone data are different from musical performance information comprising event information (including MIDI data etc.). Examples of the musical tone data are PCM data, sine composite waveform data and FM synthesizer generator data.

In accordance with the arrangement stated earlier, an overflow of data, which, for example, is caused by the overtaking of the pointer stated earlier, can be prevented since an object to be delayed is not musical performance information but musical tone data and since outputting is carried out merely with a delay (normally, the data are outputted after having been stored in a buffer). In the case of musical tone data, neither data are overflowed, nor acceptance of data can be stopped since the relationship of input and output of the data at a delay unit is 1:1 (the data volume to be inputted is equivalent to the data volume to be outputted). This is different from the case of musical performance information. Thus, it becomes possible to provide a proper ensemble musical performance by outputting musical tone data with a delay by a certain period of time.

In the musical performance control method according to a second aspect of the present invention, audio signal data may be included besides musical tone data. Specifically, one of automatic performance parts is outputted as including at least audio signal data with such a delay so as to conform to a sound production timing of the other automatic performance part, which provides an automatic musical performance based on musical performance information. As the musical sound of the one automatic performance part, an audio signal, which has a higher quality than the musical sound by, e.g., a MIDI tone generator can be utilized besides the musical sound by an electronic tone generator for an ensemble musical performance. Since the audio signal includes voice data, such as a vocal sound, an ensemble along with not only the sound of a musical instrument but also a singing voice by a person provided as musical performance information can be enjoyed, which has not been provided by prior art.

In the musical performance control method according to a third aspect of the present invention, a digital signal processor may be utilized to output the musical tone data with a delay by a certain period of time. The digital signal processor is utilized to add several sorts of acoustic effects to the musical tone data. The arrangement according to this aspect can be realized by providing some modification with an existing arrangement having a RAM and an ordinary digital processor, such as an electronic musical instrument and a sing-along machine, in terms of software.

In the musical performance control method according to a fourth aspect of the present invention, the first automatic performance part is an automatic piano player part, which provides an automatic musical performance based on the musical performance information. In this case, for example, the processing stated earlier is carried out with the other part being provided as a tone generator part, and both parts are provided as automatic performances, allowing both parts to provide a synchronized ensemble performance.

With respect to the delay output of the data, when the period of time for the delay can be automatically set according to a fifth aspect of the present invention, the operation becomes simplified. This is also applicable to the musical performance control apparatus according to a tenth aspect of the present invention, which will be explained later.

According to each of a sixth aspect to a tenth aspect of the present invention, the present invention is defined as a musical performance control apparatus, not a musical performance control method.

The sixth aspect corresponds to the first aspect. According to the sixth aspect, there is provided a musical performance control apparatus, which provides a first automatic performance part based on performance information and a second automatic performance part as an ensemble performance, comprising a processing path for the second automatic performance part; and a signal processing unit in the processing path, whereby the second automatic performance part is outputted as musical tone data with such a delay so as to conform to a sound production timing of the first automatic performance part.

The seventh aspect corresponds to the second aspect. According to the seventh aspect, there is provided a musical performance control apparatus, which provides a first automatic performance part based on musical performance information and a second automatic performance part as an ensemble performance, comprising a processing path for the second automatic performance part; and a signal processing unit in the processing path, whereby the second automatic performance part is outputted as including at least audio signal data with such a delay so as to conform to sound a generating timing of the first automatic performance part.

The eighth aspect corresponds to the third aspect. According to the eighth aspect, the signal processing unit comprises a digital signal processor.

The ninth aspect corresponds to the fourth aspect. According to the ninth aspect, the first automatic performance part is an automatic piano player part, which provides an automatic musical performance based on the musical performance information.

According to the eleventh aspect, there is provided a tone generating apparatus, which includes a signal processing unit for adding a certain acoustic effect to musical tone data outputted from an electronic tone generator side. Specifically, the signal processing unit accepts a delay time from a controller for providing an automatic performance to an external automatic performance apparatus, whereby the signal processing unit outputs musical tone data with such a delay so as to conform to a sound production timing of the external automatic performance apparatus.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Now, embodiments of the present invention will be described, referring to the accompanying drawings.

Embodiment 1

Figure 1:
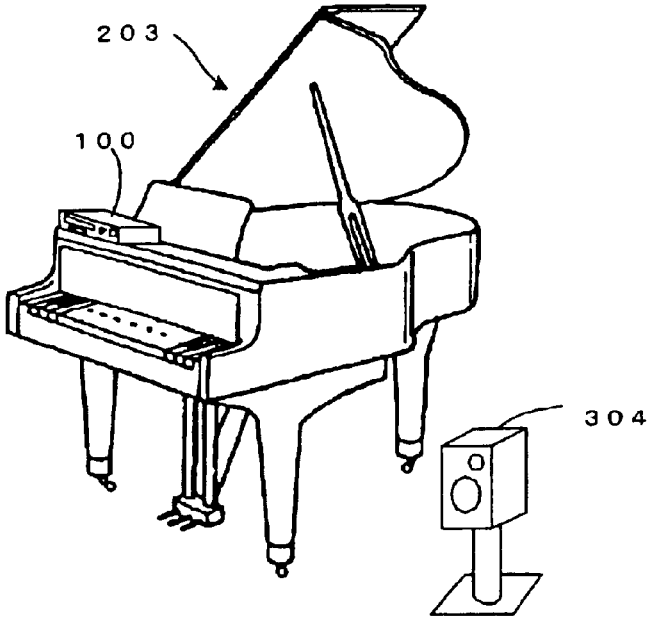
FIG. 1 is a perspective view showing the musical performance control apparatus with an automatic piano is player included therein according to a first embodiment of the present invention.
Figure 2:
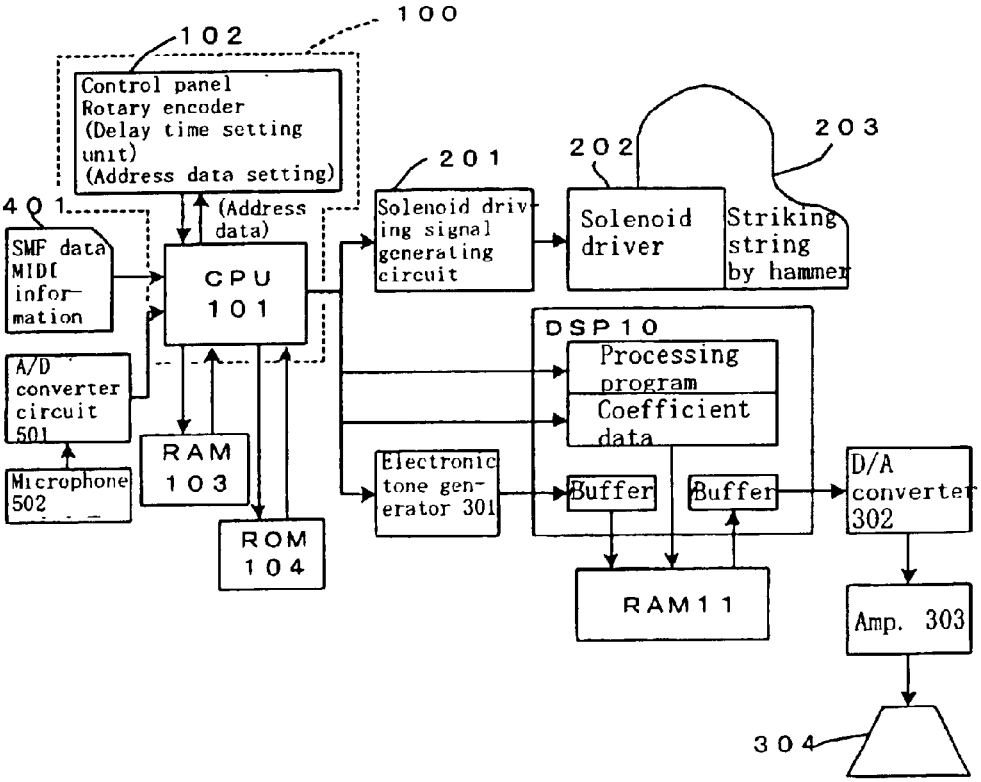
FIG. 2 is a circuit block diagram of the apparatus.

FIG. 1 is a perspective view showing the musical performance control apparatus with an automatic piano player 203 included therein according to a first embodiment of the present invention. FIG. 2 is a circuit block diagram of the apparatus. As shown in these figures, the musical performance control apparatus according to the present invention includes a main unit on a side of a controller 100, units 201–203 on an automatic piano player side and units 301–304 on an electronic tone generator side. The controller 100 includes a CPU 101, carries out the control for a solenoid driving signal generating circuit 201, musical tone data production for an electronic tone generator 301 and an operational control for a data signal processor 10, which is hereinbelow referred to as the DSP, (such as a change in the program of the DSP10), stated later. These units are configured to use a single power source as a whole.

The CPU 101 of the controller 100 is in charge of the controls for these elements and I/O processing for data. The controls are carried out by reading a program for the musical performance control apparatus from a ROM 104. When the automatic piano player 203 and the electronic tone generator provide an ensemble performance, musical performance information on a selected piece of music is stored from a floppy disk 401 into a RAM 103 by the CPU 101 (it is shown that SMF data stated later are written to the floppy disk). The musical performance information is read out by the CPU 101. In accordance with the musical performance information, a control signal is forwarded to the solenoid driving signal generating circuit 201 to generate a driving signal, providing the automatic piano player 203 with an automatic performance. The musical performance information is also forwarded to the electronic tone generator 301 by the CPU 101 to generate musical tone data. In addition, by the CPU 101, a processing program and required coefficient data for the DSP 10 are read out from the ROM 104 and are forwarded to the DSP 10. In accordance with the processing program and the coefficient data, required acoustic effects are added to the musical tone data outputted from the electronic tone generator 11, and data delay output processing is carried out as stated later. In summary, the DSP 10, which controls the RAM 11, is utilized to provide a signal processing unit for outputting the musical tone data with a delay in this embodiment.

The arrangement of the embodiment is substantially similar to the conventional arrangement in that an automatic piano player and an automatic performance by an electronic tone generator provide an ensemble performance. In the arrangement of the embodiment, the controller 100 has a microphone 502 connected thereto through an A/D converter circuit 501 so as to be provided with a sing-along machine function.

The musical performance control apparatus according to the embodiment is set at a manual performance mode (a state wherein a player plays the piano) unless a control panel 102 receives a panel input (under the condition that the controller 100 is not in the process of a performance). When selection of a piece of music or other processing is received as a panel input, the musical performance control apparatus provides an ensemble performance. When the musical tone data received by the controller 100 are data related only to the piano part, only the automatic piano play provides a performance.

Figure 3:
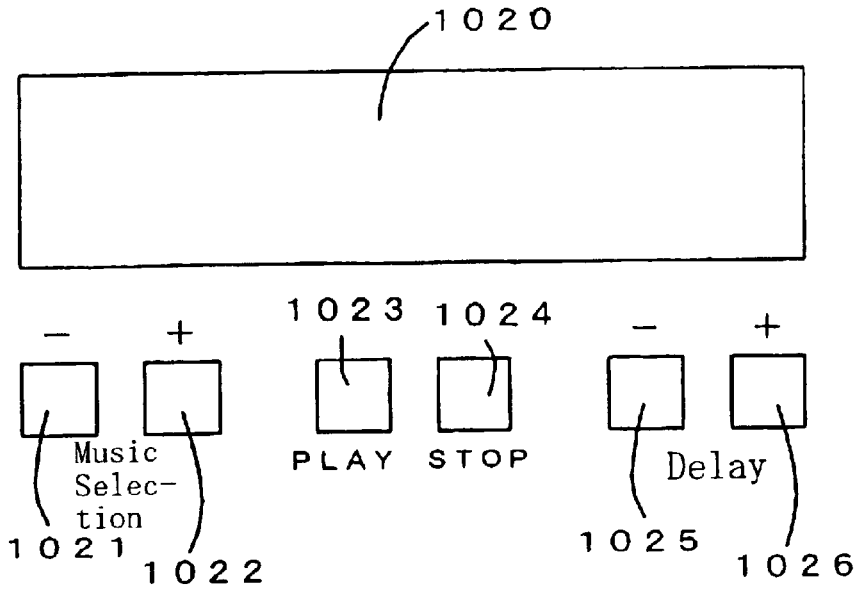
FIG. 3 is a schematic view showing an example of a control panel.

The control panel 102 includes panel switches 1021–1026 and a display 1020 for showing the operational states of the panel switches as shown in FIG. 3. As the panel switches, music selection switches 1021 and 1022, PLAY switches 1023 and 1024, and delay switches 1025 and 1026 are shown. In the display 1020, when no performance is provided, the display indicates a selected music title (or a selected music number) as, e.g., "No Song" (when no music selection is made), and "Song 1" or "Song 2" (when music selection is made). In the process of a performance, the display indicates a current performance position, a current tempo, or another factor. As stated later, a delay time can be set by a panel input. At a is delay time setting mode, the display indicates a current set delay time. The delay time is set so that the initial value is 100 ms, and the delay time can be modified at intervals of 10 ms, for instance.

Among the units on the electronic tone generator side, the DSP 10, which carries out addition of an acoustic effect, such as a reverb, has a control program set therein so that the musical tone data processed therein are outputted with a delay by a period of time instructed by a panel input as stated earlier. An example of the set delay time is about 100 ms since the time lag between the transmission of musical performance information and the actual striking of a string on the automatic piano player side is about 100 ms in the embodiment. It is needless to say that the delay time is not limited to that value, and that the delay time can be arbitrarily set so as to conform to an actual time lag.

By the CPU 101 in the controller 100, MIDI musical performance information represented by a Standard MIDI File (a sequence of timbre represented by General MIDI etc.) is read out from the floppy disk 401 through a drive (not shown) (instead of drive, the floppy disk is shown). The musical performance information thus read is temporarily stored in the RAM 301.

By the controller 100 of the musical performance information processing unit, the musical performance information is read out from the RAM 103 according to the progression of a piece of music.

Based on piano performance part information among the musical performance information thus read, the CPU 101 controls the solenoid driving signal generating circuit 201 to generate the solenoid driving signal. The signal is received by a solenoid driver 202, which drives a solenoid (not shown). The solenoid is driven to push up a key (not shown), and a string is struck by a hammer (not shown) through an action mechanism (not shown).

Electronic tone generator part information in the musical performance information is supplied to the electronic tone generator 301 simultaneously when the required performance information is supplied to the piano performance part.

In accordance with the musical performance information, the electronic tone generator 301 generates the musical tone data with an envelope added thereto, and the musical tone data are supplied to the DSP 10.

The DSP 10 adds an acoustic effect, such as a reverb, to the musical tone data. In this embodiment, the musical tone data processed in the DSP are outputted with a delay by the set period of time as stated earlier.

In other words, the DSP 10 is utilized as the signal processing unit for outputting the musical tone data with a delay. In the DSP 10, the delay is carried out as follows:

As shown in FIG. 2, the musical tone data, which are outputted from the electronic tone generator 301 as a musical tone generating circuit, are written on the RAM 11 by the DSP 10. When the set period of time has passed, the musical tone data are read out, providing a delay by that set period of time.

Explanation of the processing in the DSP 10 per se will be made. On startup, the processing program and the initial values of the coefficient data for operating the DSP 10, which have been preliminarily stored in the ROM 104 of the CPU 101, are loaded from the CPU 101 into the DSP 10. The coefficient data provided as the initial values include a write address WA specifying an address for writing the musical tone data to the RAM 11 (such as PCM digital data) and a read address RA specifying an address for reading the musical tone data.

During reproduction in an ensemble performance, the electronic tone generator 301 sequentially forwards the musical tone data to the DSP 10. The DSP 10 carries out serial writing of the musical tone data to write addresses WA in the RAM 11 and serial reading of the musical tone data from read addresses RA in the RAM 11.

The musical tone data, which have been read out by the DSP 10, are forwarded into a D/A converter circuit 302 to be converted into an analog signal. The converted analog signal is amplified by an amplifier 303 and is outputted as a musical sound from a speaker 304. When the tone generator provides a stereophonic output, processing of 2 channels for both R and L signals is carried out in the delay processing.

In that manner, the musical performance information, which is supplied to the electronic tone generator side, is converted into the musical tone data, and the musical tone data are outputted with a delay by that certain period of time under the operation of the DSP 10. This arrangement can provide sound production on the electronic tone generator side in concurrence with sound production of a string struck by the solenoid on the automatic piano player side, allowing an ensemble performance without a time lag. In the embodiment, even when musical performance information having a high density is inputted, the DSP 10 provides the delay output by carrying out the serial writing to write addresses WA of the RAM 11 and the serial reading from read addresses of the RAM 11 in the form of musical tone data. As a result, a pointer can be prevented from overtaking to cause an overflow of data as stated earlier, providing a proper ensemble performance.

Explanation of a delay amount will be made. The RAM 11 sequentially increments the write addresses WA and the read addresses RA at a sampling frequency of fs. Read addresses RA are specified so that they have addresses to corresponding write addresses with a shift by an n address (n is determined by fs and the delay amount). The digital musical tone data stored in the write addresses are read out from the read addresses with a delay by $t_{delay}$=n/fs after having stored in the RAM 11. This means that the musical tone digital signal outputted from the electronic tone generator 301 is outputted to the D/A converter circuit 302 in such fashion that the DSP 10 delays the output to the D/A converter circuit by a delay time of $t_{delay}$=n/fs after the output from the electronic tone generator 301. The maximum delay amount depends on the capacity of the RAM 11. Even when the musical performance data have a high density, the operational principle of the DSP 10 can prevents the delay processing from becoming impossible (an overflow from being caused) as long as read addresses can be specified.

Explanation of the setting of the delay time by the DSP 10 will be made. With respect to the initial values of the coefficient data including the initial value of the delay amount, the values on a latest shutdown are configured to be stored. When the delay amount is changed, the delay amount is set by the operating switch 1025 or 1026 in the control panel 102. Based on the data that are set by the operating switch 1025 or 1026, the write addresses RA are set by using a table or another tool for conversion of the set data into the write addresses RA, which is stored in the CPU 101. The converted data are transmitted to the DSP 10. The delay time setting unit is not limited to a configuration with push buttons as operating switches. The delay time setting unit may be configured to include a rotary encoder or an infrared controller.

Explanation of the file format of the Standard MIDI file and the sequence of timbre represented by the General MIDI, which are read out from the floppy disc 401, will be made.

Figure 4:
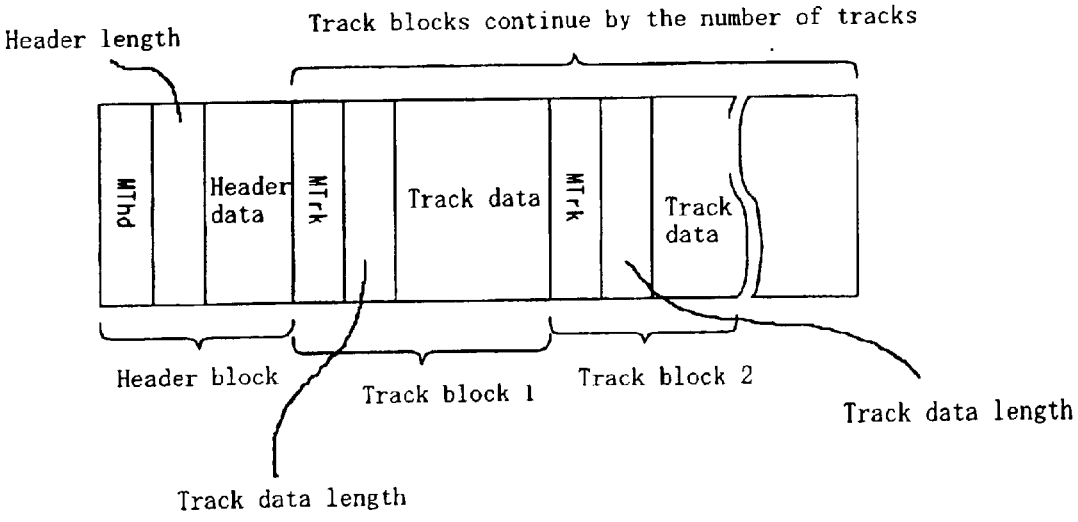
FIG. 4 is a schematic view showing the basic format structure of a standard MIDI file.

FIG. 4 shows the basic format structure of the Standard MIDI file. In the Standard MIDI file, a format 0 and a format 1 are normally used. FIG. 4 is an example of the format 1. In the case of the format 0, a single track block is used. The track data comprise ① an MIDI event, ② a system exclusive event and ③ a Meta event.

① MIDI event: The MIDI event includes a delta time and an MIDI channel message. The MIDI channel message includes key depression information (9n Key No. Velocity), key release information (8n Key No. Velocity), timbre information (Cn timbre No.), pedal information (Bn 40 7F or 00) and other information (wherein n=0–F, 1ch–16ch).

Figure 5:
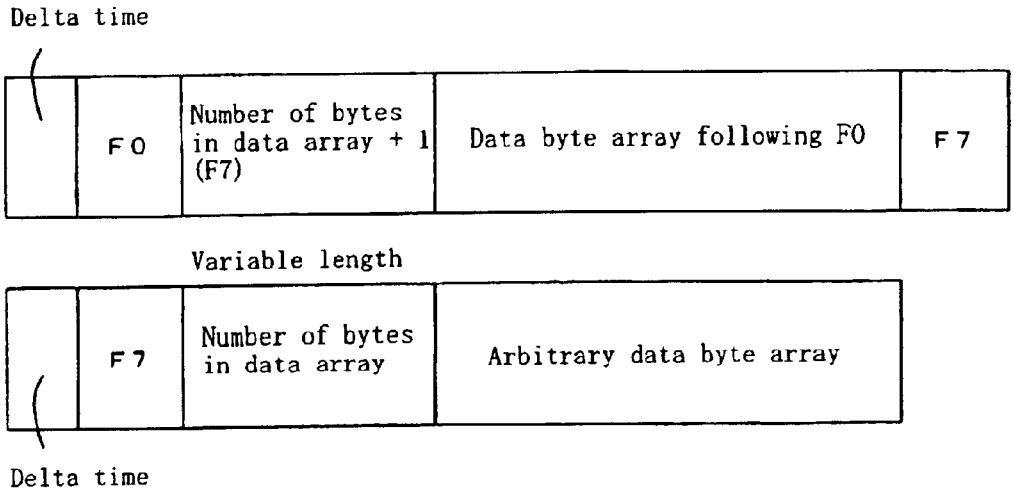
FIG. 5 is a schematic view showing the structure of a system exclusive event.

② System exclusive event: The structure of the system exclusive event is shown in FIG. 5. It is used for information that cannot be expressed as ① the MIDI event or ③ the Meta event. An example of the system exclusive event is the kind of an acoustic effect.

Figure 6:
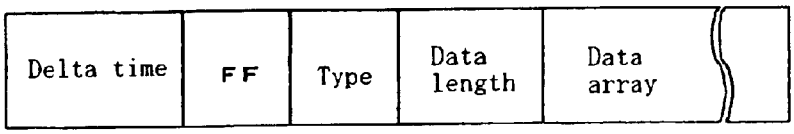
FIG. 6 is a schematic view showing the structure of a Meta event.

③ Meta event: The structure of the Meta event is shown in FIG. 6. It is used for a tempo, a beat, completion of track data or the like.

With respect to the timbre represented by in the general MIDI, a standard reference/timbre table may be used. Although the table is not shown, the numbers indicated in the table usually designate timbre numbers of the timbre information. Since the actual timbre numbers start with 0, the actual timbre numbers in the data correspond to values that are obtained by subtracting 1 from the numbers indicated in the table. Although the number 1 indicated in the Table designates an Acoustic Grand Piano, it corresponds to the timbre No.=0 in the actual data. When an ensemble performance is provided, only this timbre is provided by an automatic piano player. Alternatively, the performance by the Bright Acoustic Piano as the number 2 indicated on the Table may be provided.

Various kinds of pianos as other numbers 3–6 or another arbitrary timbre No. may be set as a part provided by the automatic piano player.

Figure 7:
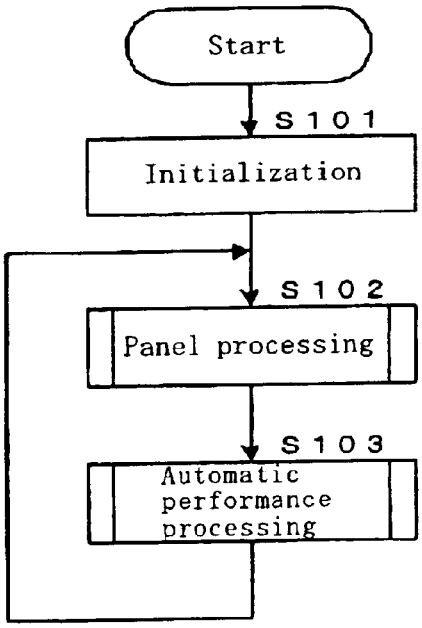
FIG. 7 is a flowchart showing basic processing in the musical performance control apparatus.

FIG. 7 is a flowchart showing basic processing in the musical performance control apparatus. As shown in this figure, when the power source of the apparatus is turned on, initialization processing is executed (Step S101). Then panel processing including panel-scanning of the panel switches 1021–1026 etc. provided on the control panel 102 of the apparatus (Step S102) is executed. After that, automatic performance processing is executed (Step S103).

Figure 8:
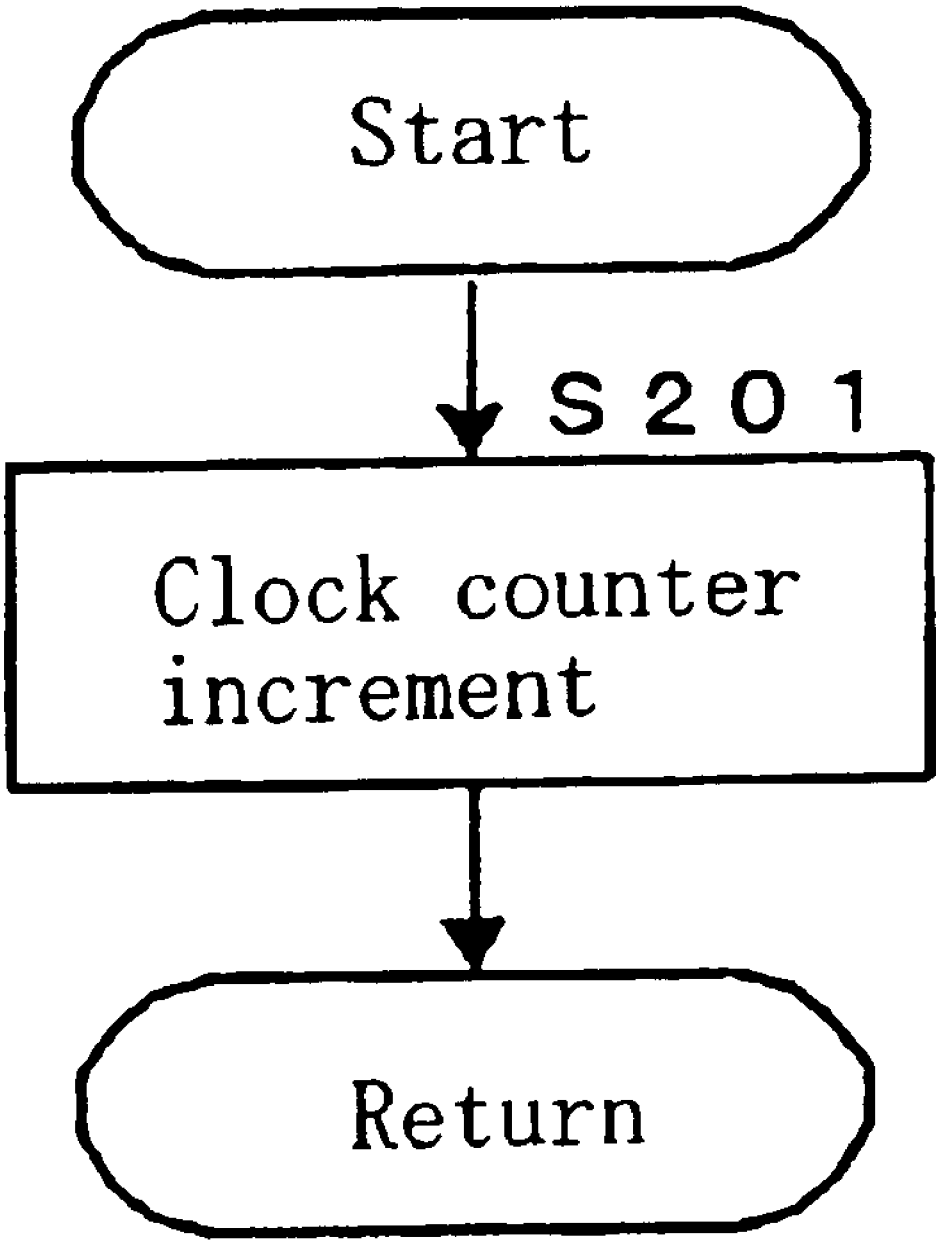
FIG. 8 is a flowchart showing a processing flow in tempo timer interrupt processing.

FIG. 8 is a flowchart showing a processing flow in tempo timer interrupt processing, which is required to assure a proper tempo when a piece of music is provided in an automatic performance. Whenever the interrupt processing is executed, a clock counter is incremented (Step S201).

Figure 9:
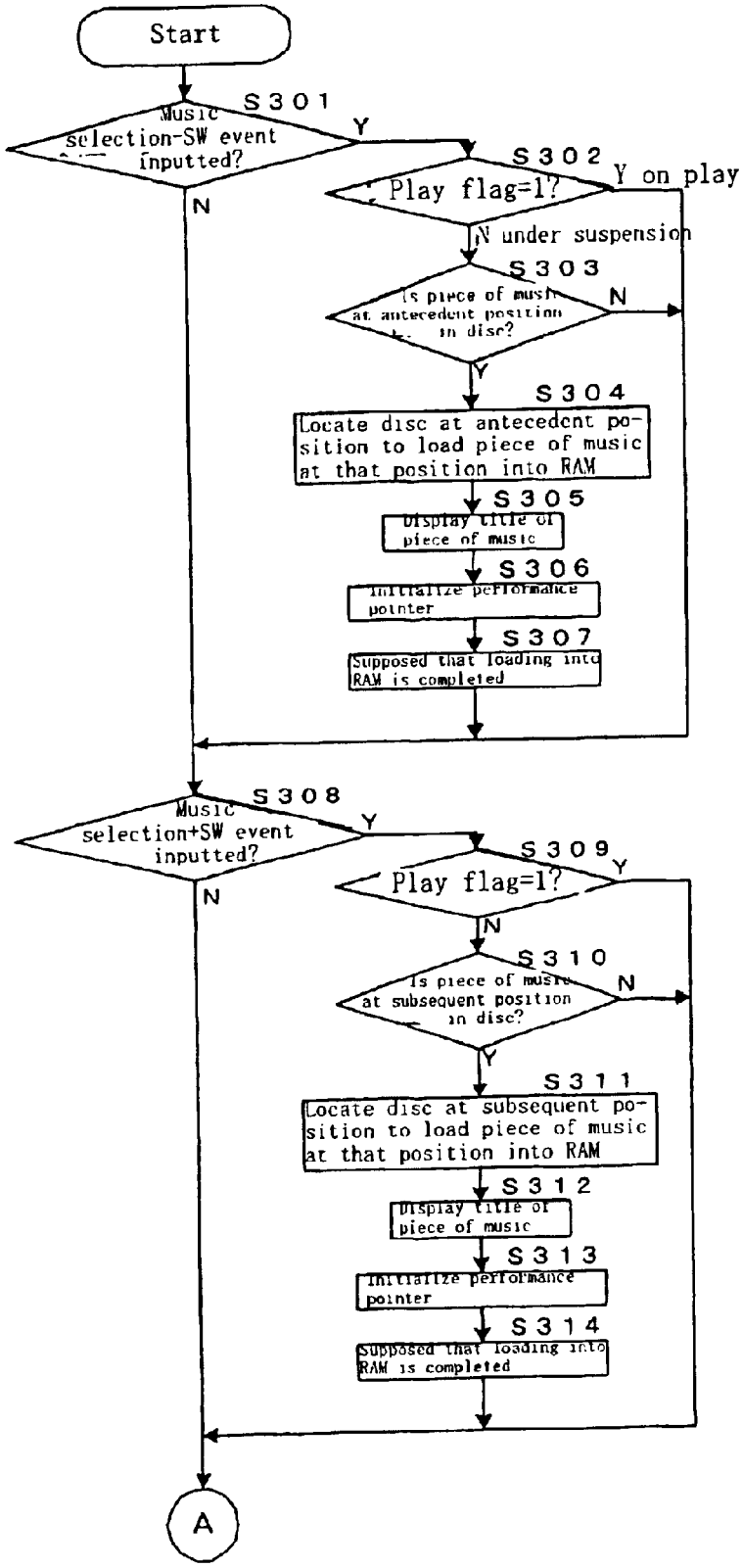
FIG. 9 is a flowchart showing a processing flow for panel processing.
Figure 10:
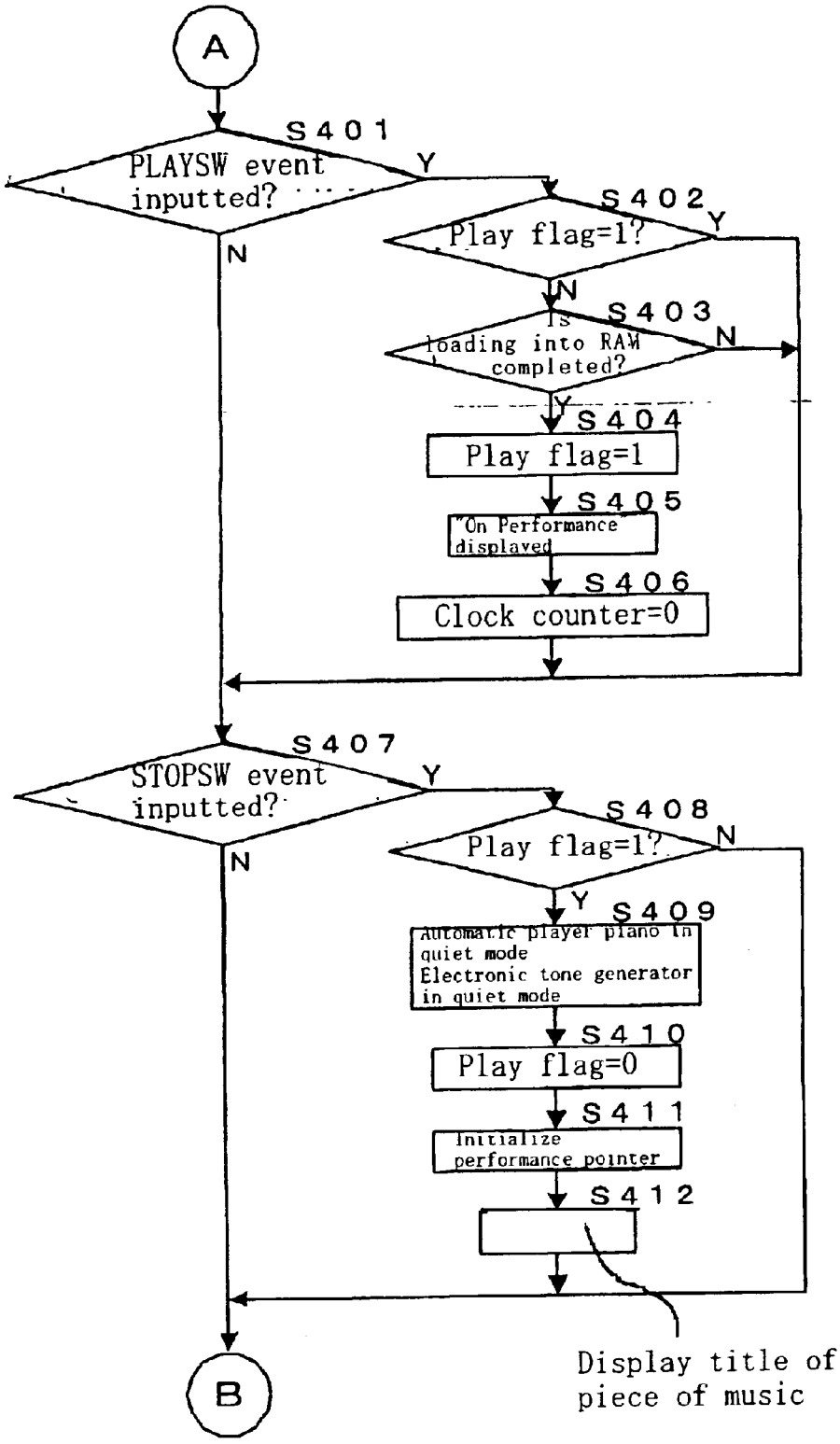
FIG. 10 is a flowchart showing a continuation of the processing flow shown in FIG. 9.
Figure 11:
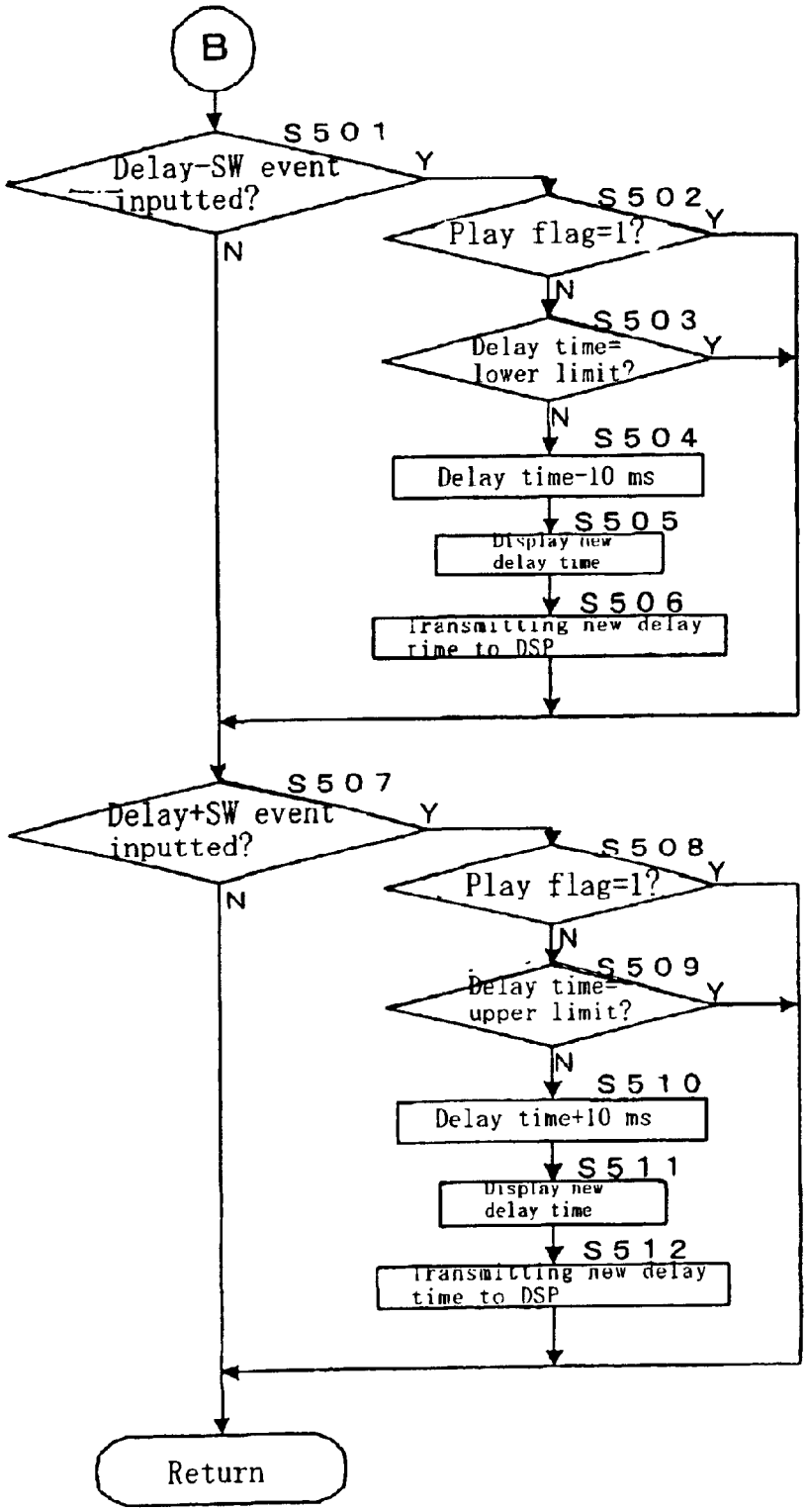
FIG. 11 is a flowchart showing a continuation of the processing flow shown in FIG. 10.

FIGS. 9–11 are flowcharts showing a processing flow for the panel processing. As shown in FIG. 9, it is checked at first whether a switch event has been inputted by the music selection switch 1021 or not (Step S301). When the switch event has not been inputted (No at Step S301), the processing proceeds to Step 308 stated later. When the switch event has been inputted (Yes at Step S301), it is checked whether a play flag is set (=1) or not (Step S302). When the flag is set (Yes at Step S302), it is supposed that it is on play, and the processing proceeds to Step S308 stated later. On the contrary, when the play flag is not set (No at Step S302), it is supposed that it is under suspension, and it is checked whether the floppy disc 401 has a piece of music stored at a antecedent position to the piece of music specified by the music selection switch or not (Step S303). When there is no piece of music at the antecedent position (No at Step S303), the processing proceeds to Step S308 stated later as in Yes at Step 302. On the contrary, when there is a piece of music at the antecedent position (Yes at Step S303), the disc is located at the antecedent position to load the piece of music at that position into the RAM 103 (Step S304). The title of the selected piece of music is displayed on the display (Step S305). A performance pointer is initialized (Step S306), and it is supposed that loading the selected piece of music into the RAM 103 is completed (Step S307).

At Step 308, it is checked whether a switch event has been inputted by the music selection switch 1022 or not (Step S308). When the switch event has not been inputted (No at Step S308), the processing proceeds to Step S401 stated later. When the switch event has been inputted (Yes at Step S308), it is checked whether a play flag is set (=1) or not (Step S309). When the flag is set (Yes at Step 309), it is supposed that it is on play, and the processing proceeds to Step S401 stated later. On the contrary, when the play flag is not set (No at Step S309), it is supposed that it is under suspension, and it is checked whether the floppy disc 401 has a piece of music stored at a subsequent position to the piece of music specified by the music selection switch or not (Step S310). When there is no piece of music at the subsequent position (No at Step S310), the processing proceeds to Step S401 stated later as in Yes at Step 309. On the contrary, when there is a piece of music at the subsequent position (Yes at Step S310), the disc is located at the subsequent position to load the piece of music at that position into the RAM 103 (Step S311). The title of the selected piece of music is displayed on the display (Step S312). The performance pointer is initialized (Step S313), and it is supposed that loading the selected piece of music into the RAM 103 is completed (Step S314).

FIG. 10 is a flowchart showing a continuation of the processing flow shown in FIG. 9. It is checked at first whether an event has been inputted by the PLAY switch or not (Step S401). When the switch event has not been inputted (No at Step 401), the processing proceeds to Step 407 stated later. When the switch event has been inputted (Yes at Step S401), it is checked whether a play flag is set (=1) or not (Step S402). When the flag is set (Yes at Step 402), it is supposed that it is on play, and the processing proceeds to Step S407 stated later. On the contrary, when the play flag is not set (No at Step S402), it is supposed that it is under suspension, and it is checked whether the selected piece of music has been loaded into the RAM 103 or not (Step S403). When the selected piece of music has not been loaded (No at Step S403), the processing proceeds to Step S407 stated later as in Yes at Step 402. On the contrary, when the selected piece of music has been loaded (Yes at Step S403), the play flag is set (=1) (Step 404), "On performance" is displayed (Step S405), and the clock counter is set to 0 (Step S406).

At Step 407, it is checked whether a switch event has been inputted by the STOP switch 1022 or not (Step S407). When the switch event has not been inputted (No at Step S407), the processing proceeds to Step S501 stated later. When the switch event has been inputted (Yes at Step S407), it is checked whether a play flag is set (=11) or not (Step S408). When the flag is not set (No at Step S408), the processing proceeds to Step S501 stated later. On the contrary, when the play flag is set (Yes at Step S408), the automatic piano player 203 and the electronic tone generator 301 are in a quiet mode (Step S409). The play flag is set to 0 (Step S410), the performance pointer is initialized (Step S411), and the title of the selected piece of music is displayed (Step S412).

FIG. 11 is a flowchart showing a continuation of the processing flow shown in FIG. 10. It is checked at first whether a switch event has been inputted by the delay switch 1025 or not (Step S501). When the switch event has not been inputted (No at Step 501), the processing proceeds to Step 507 stated later. When the switch event has been inputted (Yes at Step S501), it is checked whether the play flag is set (=1) or not (Step S502). When the flag is set (Yes at Step S502), it is supposed that it is on play, and the processing proceeds to Step S507 stated later. On the contrary, when the play flag is not set (No at Step S502), it is supposed that it is under suspension, and it is checked whether the delay time that has been already set is at a lower limit or not (Step S503). When the delay time is at the lower limit (Yes at Step S503), the processing proceeds to Step S507 stated later. On the contrary, when the delay time is not at the lower limit (No at Step S503), a period of time of 10 ms is subtracted from the current delay time (Step S504), the new delay time is displayed on the display 1020 (Step S505), and coefficient data corresponding to the new delay time are transmitted to the DSP 10 (Step S506).

At Step S507, it is checked at first whether a switch event has been inputted by the delay switch 1026 or not (Step S507). When the switch event has not been inputted (No at Step S507), the processing proceeds to the automatic performance processing (Step S103). When the switch event has been inputted (Yes at Step S507), it is checked whether the play flag is set (=1) or not (Step S508). When the flag is set (Yes at Step S508), it is supposed that it is on play, and the processing proceeds to the automatic performance processing (Step S103). On the contrary, when the play flag is not set (No at Step S508), it is supposed that it is under suspension, and it is checked whether the delay time that has been already set is at an upper limit or not (Step S509). When the delay time is at the upper limit (Yes at Step S509), the processing proceeds to the automatic performance processing at Step S103. On the contrary, when the delay time is not at the upper limit (No at Step S509), a period of time of 10 ms is added to the current delay time (Step S510), the new delay time is displayed on the display 1020 (Step S511), and coefficient data corresponding to the new delay time are transmitted to the DSP 10 (Step S512).

Figure 12:
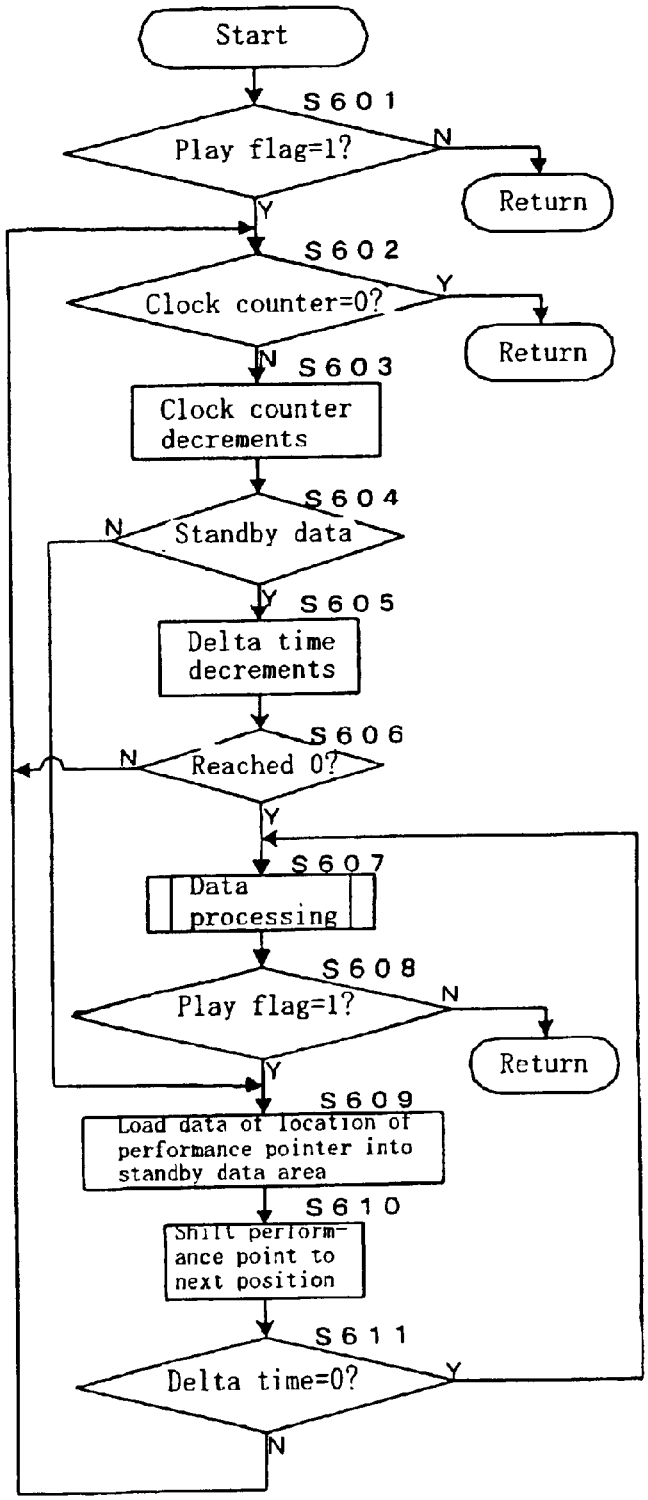
FIG. 12 is a flowchart showing a processing flow in an automatic musical performance processing when an SMF format is 0.

FIG. 12 is a flowchart showing a processing flow in the automatic musical performance processing when an SMF format is 0. As shown in this figure, it is checked at first whether the play flag is set or not (Step S601). When the play flag is not set (No at Step 601), it is supposed that a performance is not ready, and the processing returns to the first processing shown in FIG. 7 (Return). On the contrary, when the play flag is set (Yes at Step S601), it is supposed that the performance is ready, and it is checked whether the clock counter is 0 or not (Step S602). When the clock counter is 0 (Yes at Step S602), it is supposed that the performance has not started, and the processing returns to the first processing (Return). On the contrary, when the clock counter is not 0 (No at Step S602), the clock counter is decremented (Step S603), it is checked whether standby data exist or not (Step S604). When no standby data exist (No at Step S604), the processing proceeds to Step 609 stated later. On the contrary, when standby data exist (Yes at Step S604), the delta time in the track data of the MIDI is decremented (Step S605). It is checked whether the delta time has reached 0 or not (Step S606). When the delta time has not reached 0 (No at Step S606), the processing returns to the previous Step 602. On the contrary, when the delta time has reached 0 (Yes at Step S606), the processing proceeds to data processing stated later in reference to FIGS. 13 and 14 (Step S607). And then, it is checked whether the play flag is set or not (Step S608). When the play flag is not set (No at Step S608), it is supposed that the performance processing has been completed, and the processing returns to the first processing (Return). On the contrary, when the play flag is set (Yes at Step S608), it is supposed that a performance is going on, and the data specifying the location of the performance pointer are loaded into a standby data area (Step S609). And then, the performance pointer is shifted to the next position (Step S610). Further, it is checked whether the delta time is 0 or not (Step 611). When the delta time is 0 (Yes at Step S611), the processing returns to the previous Step S607 to execute the data processing. On the contrary, when the delta time is not 0 (No at Step S611), the processing returns to the previous Step S602.

Figure 13:
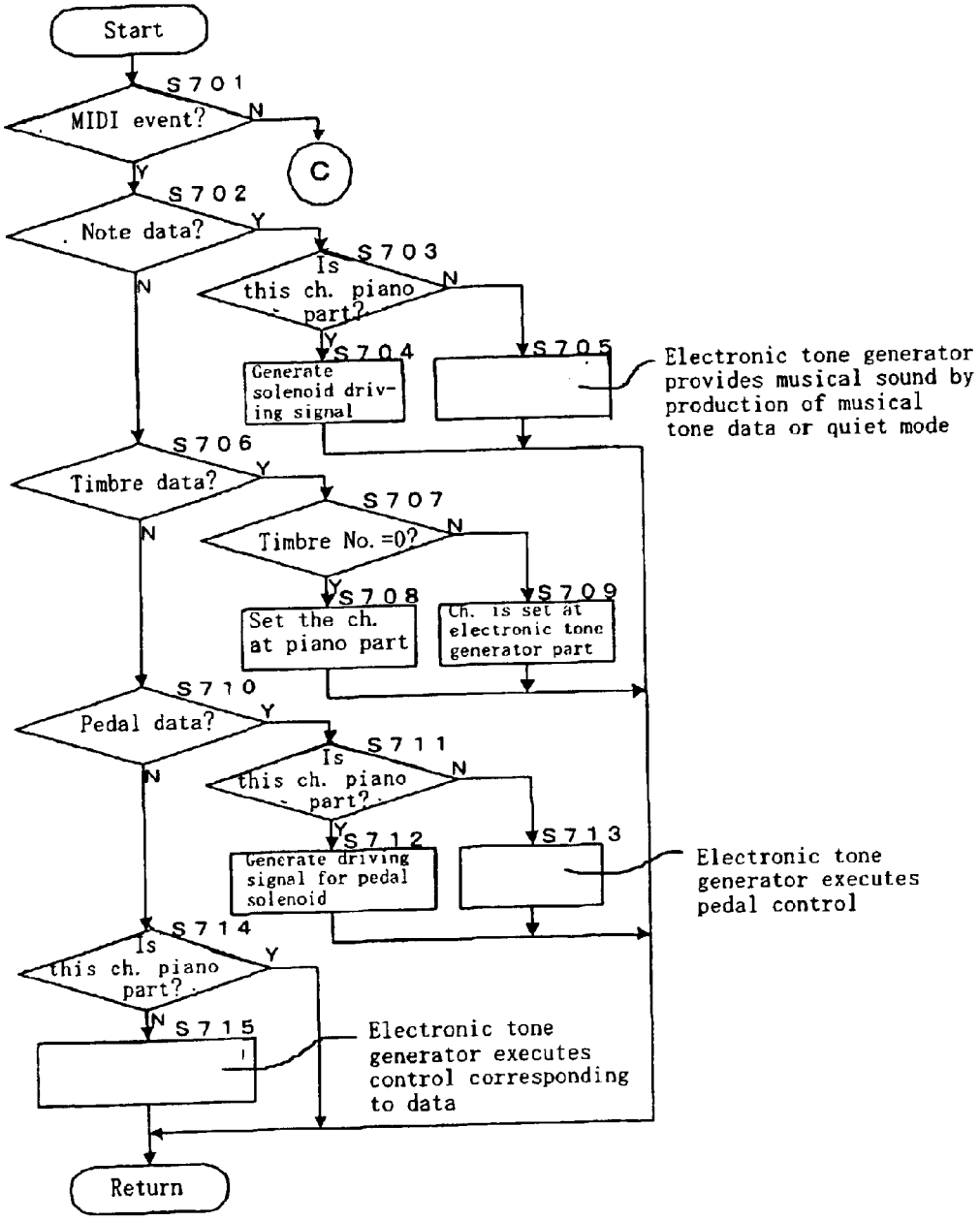
FIG. 13 is a flowchart showing a processing flow in the data processing at Step S607 in FIG. 12.

FIG. 13 is a flowchart showing a processing flow in the data processing at Step S607 in FIG. 12. It is checked at first whether an object for data processing is an MIDI event or not (Step S701). When the object is not an MIDI event (No at Step S701), the processing proceeds to Step S801 stated later in reference to FIG. 14. When the object is an MIDI event (Yes at Step S701), it is checked whether the data as the processing object are note data or not (Step S702). When the data are note data (Yes at Step S702), it is checked whether this channel is the piano part or not (Step S703). When the this channel is the piano part (Yes at Step S703), the solenoid driving signal generating circuit 201 generates a solenoid driving signal (Step S704), and a string of the automatic piano player is struck. On the contrary, when this channel is not the piano part (No at Step S703), the electronic tone generator 301 provides a musical sound by production of musical tone data or provides a quiet mode (Step S705). After that, the processing returns to the first processing.

On the other hand, when the data as the processing object at Step S702 are not note data (No at Step S702), it is checked whether the data as the processing object is timbre data or not (Step S706). When the data is timbre data (Yes at Step S706), it is checked whether the timbre No. specified by the data is 0 (i.e., the timbre of an Acoustic Grand Piano) or not (Step S707). When the timbre No. is 0 (Yes at Step S707), the channel is set at the piano part (Step S708). On the contrary, when the timbre No. is not 0 (No at Step S707), the channel is set at the electronic tone generator part (Step S709). After that, the processing returns to the first processing (Return). As stated earlier, an arbitrary No., such as any one of Nos. 3–6, may be assigned to the automatic piano player part.

When the data as the processing object at Step S706 are not timbre data (No at Step S706), it is checked whether the data as the processing object is pedal data or not (Step S710). When the data is pedal data (Yes at Step S710), it is checked whether the channel is the piano part or not (Step S711). When the channel is the piano part (Yes at Step S711), a driving signal for a pedal solenoid (not shown) is generated, and the automatic piano player 203 executes pedal processing. On the contrary, when the channel is not the piano part (No at Step S711), the electronic tone generator 301 executes a pedal control (Step S713). After that, the processing returns to the first processing (Return).

In addition, when the data as the processing object at Step S710 are not pedal data (No at Step S710), it is checked whether the channel is the piano part or not (Step S714). When the channel is the piano part (Yes at Step S714), the processing returns to the first processing (Return). On the contrary, when the channel is not the piano part (No at Step S714), the electronic tone generator 301 executes a control corresponding to the data (Step S715), and the processing returns to the first processing (Return).

Figure 14:
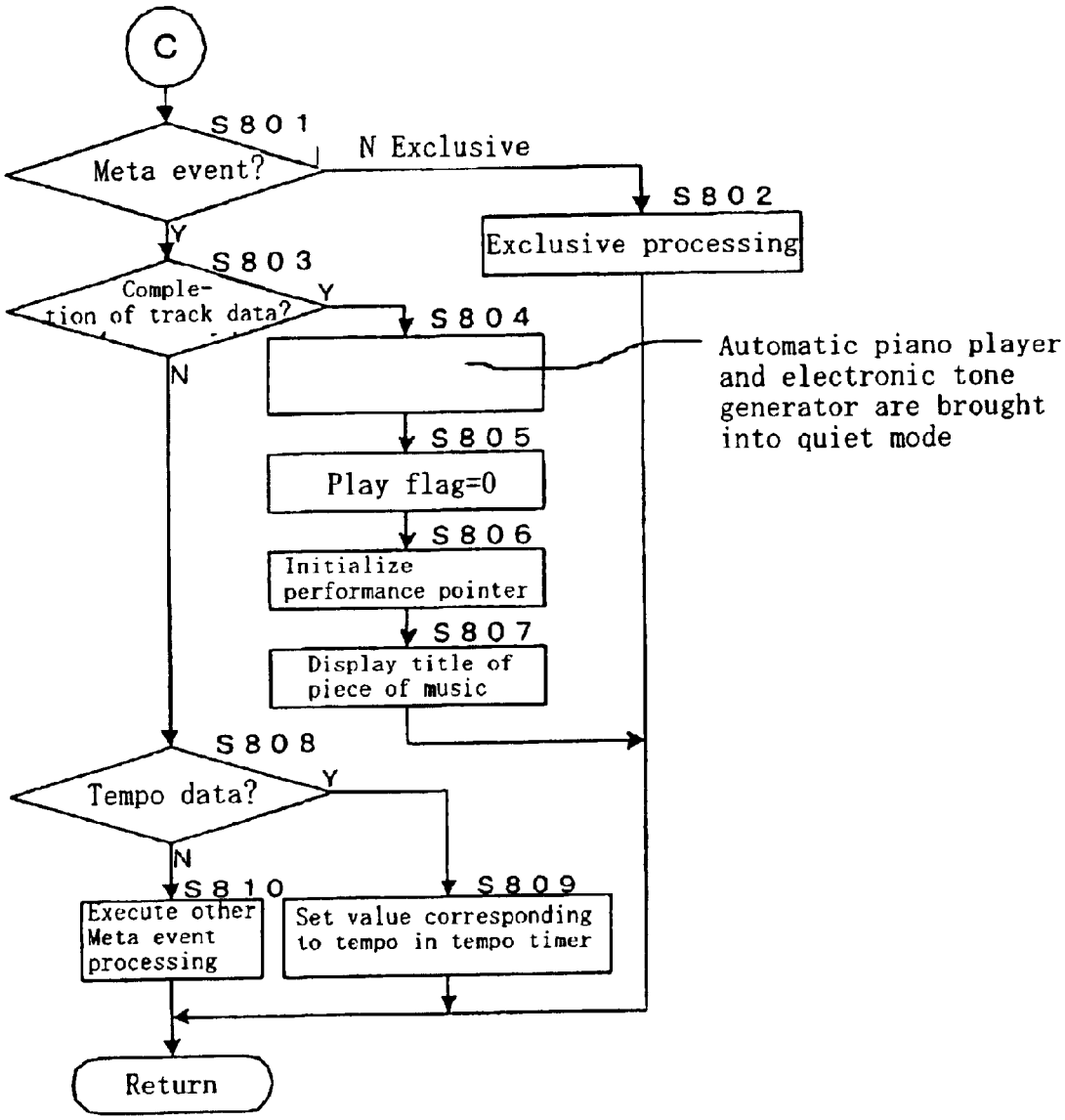
FIG. 14 is a flowchart showing a processing flow, which is executed when it is determined that the data to be subjected to processing at Step S701 in FIG. 13 are not an MIDI event.

FIG. 14 is a flowchart showing a processing flow, which is executed when it is determined that the data to be subjected to processing at Step S701 in FIG. 13 are not an MIDI event. It is checked at first whether data as the processing object are a Meta event or not (Step S801). When the data are not a Meta event (No at Step S801), it is supposed that the data are exclusive data, and exclusive processing is executed (Step S802). On the contrary, when the data are a Meta event (Yes at Step S801), it is checked whether the data are an event of completion of the track data or not (Step S803). When the data are an event of completion of the track data (Yes at Step S803), the automatic piano player 203 and the electronic tone generator 301 are brought into a quiet mode (Step S804). Then, the play flag is set at 0 (Step S805), the performance pointer is initialized (Step S806), the title of the piece of music is displayed (Step S807), and the processing returns to the first processing (Return).

When the data are not an event of completion of the track data (No at Step S803), it is checked whether the data as the processing object are tempo data or not (Step S808). When the data are tempo data (Yes at Step S808), a value corresponding to the temp is set in the tempo timer (Step S809), and the processing returns to the first processing (Return). On the contrary, when the data are not tempo data (No at Step S808), other Meta event processing is executed (Step S810), and the processing returns to the first processing (Return).

As explained, the DSP 10, wherein an acoustic effect, such as a reverb, is added to the musical tone data, is configured to output the musical tone data processed therein with a delay by the preset period of time. In other words, the DSP 10 works a role similar to a delay buffer with respect to the musical tone data to be processed and outputted therein. However, the data to be delayed are not musical performance information but musical tone data unlike the prior art. Since the data are outputted after having been stored once, the data can be prevented from overflowing due to the overtaking of the pointer as stated earlier or another reason.

Although the delay time is set by a user's delay switch operation in the embodiment, the delay time may be automatically set. Specifically, the automatic piano player 203 may be provided with a hammer sensor (not shown) for detecting a key depressing timing so that when the controller 100 outputs musical performance information on a typical key, the time lag between the output of the musical performance information and the key depression by the hammer is measured. By this arrangement, the delay time can be automatically set. Read address data for setting the delay time corresponding to the measured time lag are calculated by a processing program preliminarily stored in the CPU 101, and the read address data are outputted to the DSP 10 to automatically set the delay time.

As the sensor for detecting the key depressing timing, e.g., a microphone for detecting a string struck sound and a piezoelectric sensor for detecting the vibration of a sound board or a string can be utilized besides the hammer sensor for detecting the movement of a hammer, such as a photosensor or a magnetic sensor.

Figure 15:
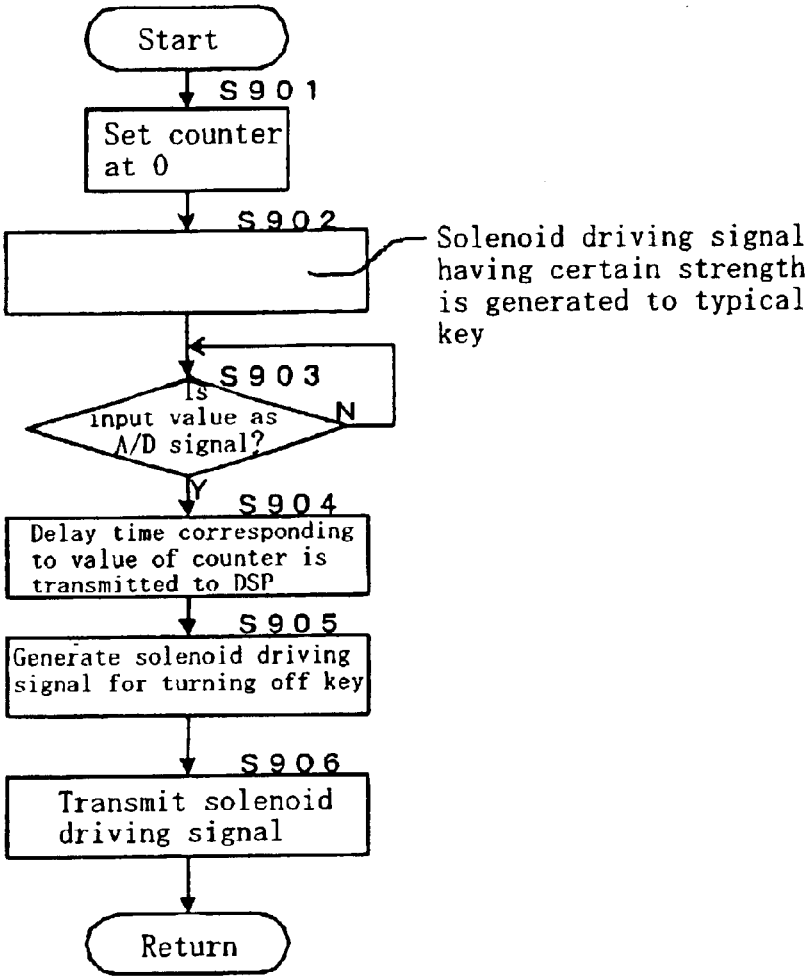
FIG. 15 is a flowchart showing a processing flow for automatic setting of a delay time.
Figure 16:
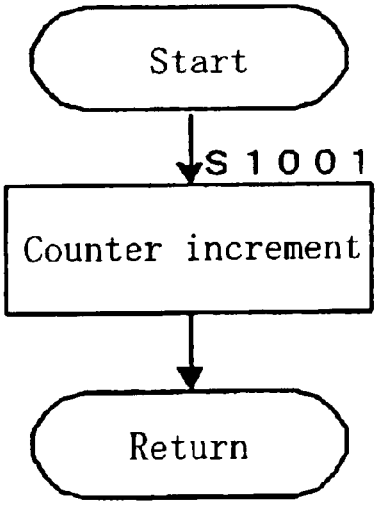
FIG. 16 is a flowchart showing timer interrupt processing for a counter in the automatic setting of the delay time.

FIG. 15 is a flowchart showing a processing flow for automatic setting of the delay time, and FIG. 16 is a flowchart showing timer interrupt processing (e.g., an interrupt of 1 ms) for the counter in the automatic setting of the delay time. The counter is set at 0 at first (Step S901), and a solenoid driving signal having a certain strength is generated to the typical key (Step S902). It is checked whether an input value as an A/D signal is transmitted from, e.g., the hammer sensor through a converter or not (Step S903). When the input value is transmitted (Yes at Step S903), the delay time corresponding to the value of the counter is transmitted to the DSP 10 (Step 904). After that, a solenoid driving signal for turning off the key is generated (Step S905), and the solenoid driving signal is transmitted to the solenoid driver 202 (Step S906). Then, the processing returns to the first processing (Return). As shown in FIG. 16, the interrupt processing is executed at intervals of, e.g., 10 ms, and the counter for measuring the time lag is incremented (Step S1001). When the timer interrupt is executed at intervals of 1 ms, and when the value of the counter is 500, the delay time is automatically set at 500 ms.

Embodiment 2

Figure 17:
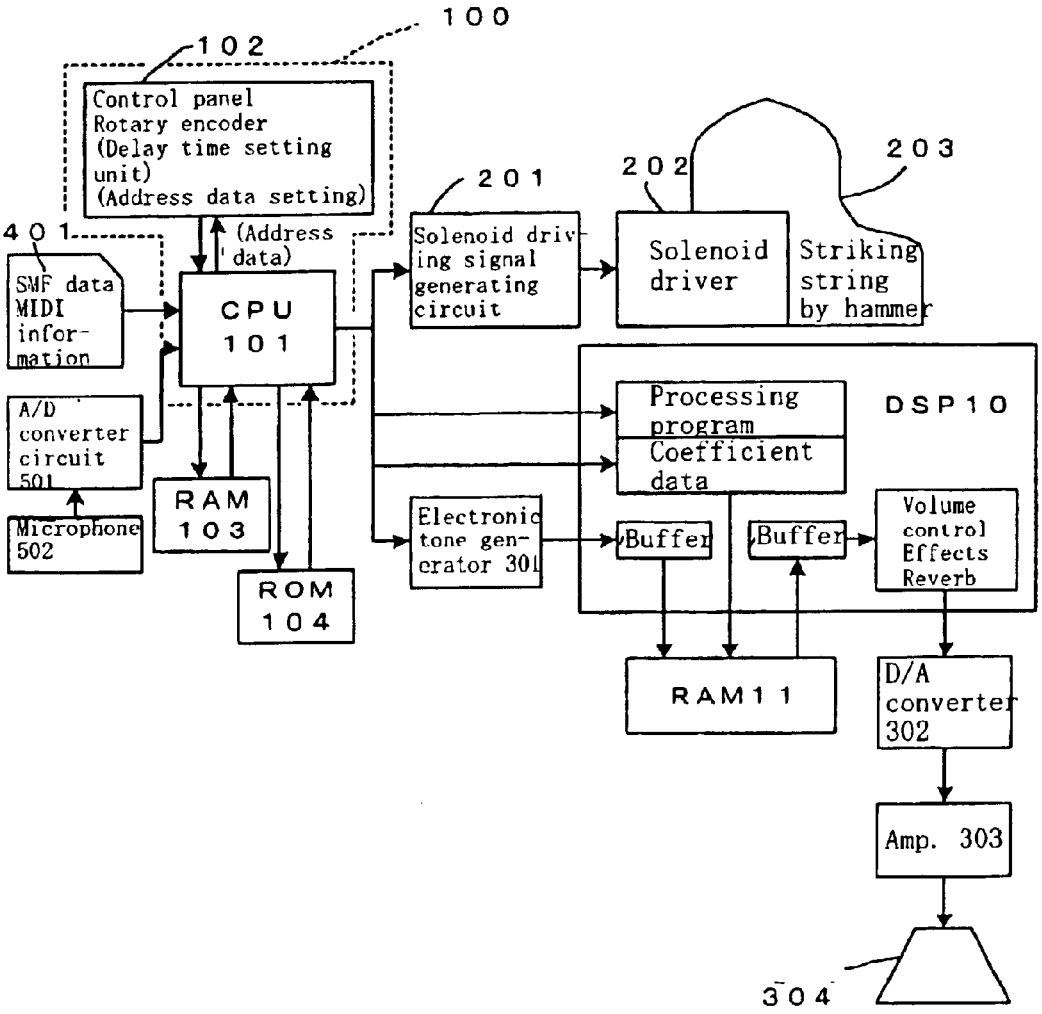
FIG. 17 is a circuit block diagram according to a second embodiment of the present invention, showing how a DSP provides a volume control, various sorts of acoustic effects including a reverb and data delay output processing to musical tone data.

FIG. 17 is a circuit block diagram showing how the DSP provides a volume control, various sorts of acoustic effects (effects) including a reverb to the musical tone data outputted with a delay by the DSP 10 on the side of the electronic tone generator 301 in the arrangement identical to that of Embodiment 1. Explanation of the basic arrangement is omitted since the basic arrangement is identical to Embodiment 1. By this embodiment, it can be seen that the musical performance control apparatus according to the present invention can be provided by utilizing a conventional DSP 10 for providing a volume control and adding various sorts of acoustic effects, and adding a processing program and coefficient data for the delay processing to the processing program and coefficient data in the conventional DSP.

Embodiment 3

Figure 18:
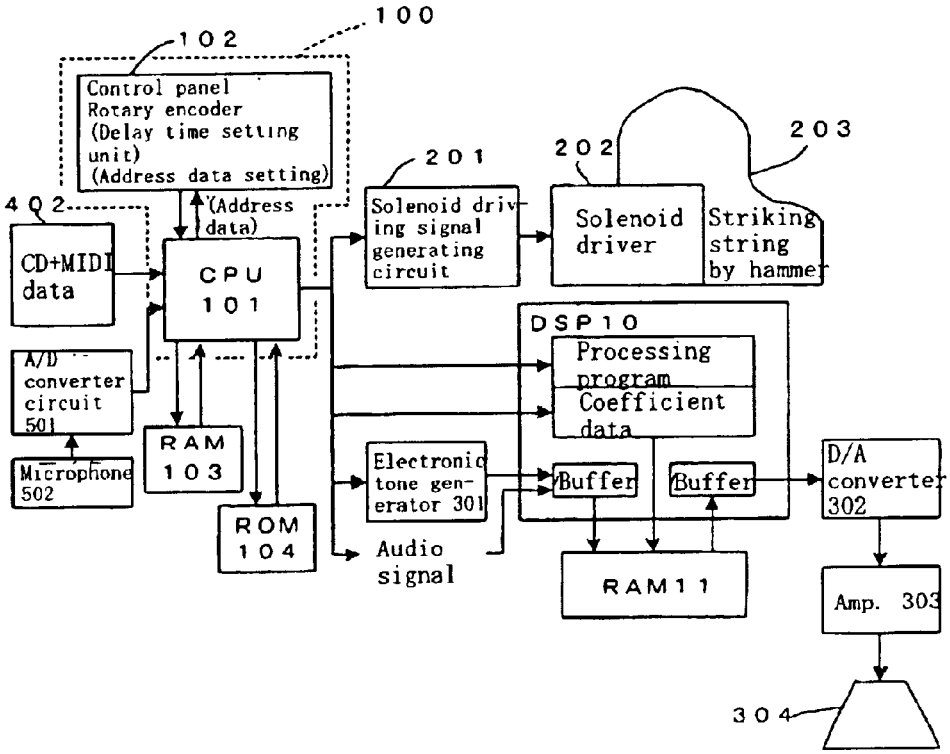
FIG. 18 is a circuit block diagram showing the musical performance controlling apparatus with an automatic piano player included therein according to a third embodiment of the present invention.
Figure 19:
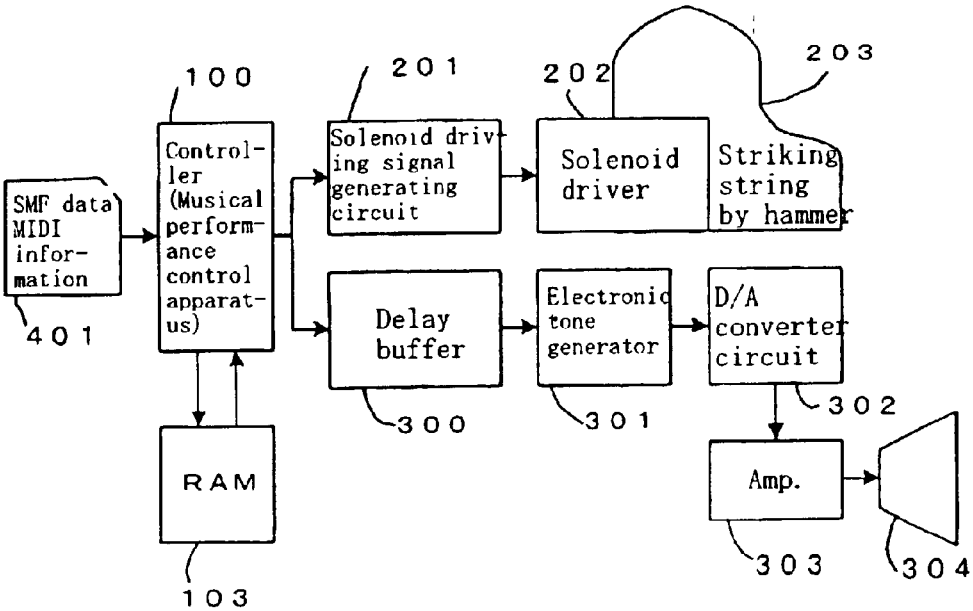
FIG. 19 is a circuit block diagram showing a conventional system, wherein a time lag between the sound production by an automatic piano player and the sound production by an electronic tone generator part is avoided.
Figure 20:
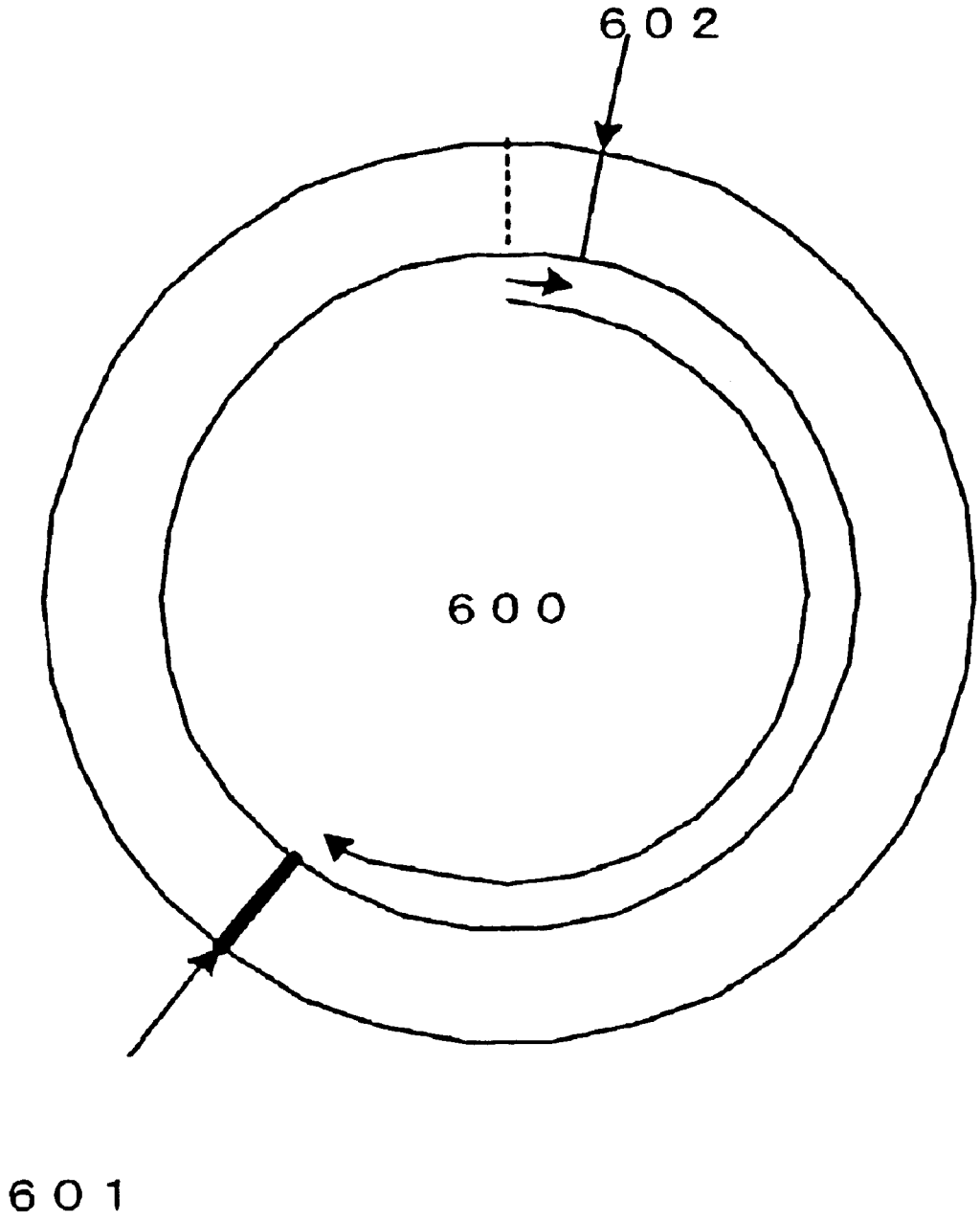
FIG. 20 is a schematic view showing a ring buffer for storing musical performance information.

FIG. 18 is a circuit block diagram showing the musical performance control apparatus with the automatic piano player 203 included therein according to another embodiment of the present invention. As shown in FIG. 18, the basic arrangement of this embodiment is substantially the same as that of Embodiment 1 or Embodiment 2.

However, in the arrangement of this embodiment, the musical performance information comprising MIDI data and audio signal data including a voice or a performance sound by a musical instrument are loaded into the controller 100 from a CD to be loaded. The object to be loaded is not limited to a CD. Examples of the object are a CD-R, a CD-RW, a DVD-ROM, a DVD-RAM, a DVD-R, a DVD-RW, a DVD+RW, and any other types.

The musical tone data outputted from the electronic tone generator 301 and the audio signal data are inputted to the DSP 10 to be provided with addition of a required acoustic effect. In addition, the musical tone or the voice based on the data is outputted with a delay by a certain period of time by the DSP.

Since the time lag between the transmission of musical performance information and the actual striking of a string in the arrangement on the side of the automatic piano player 203 is about 100 ms in this embodiment as well, the delay time is set at the DSP 10 so as to have the same period of time. However, the delay time is not limited to this period of time as in the pervious embodiments.

Since the musical tone data outputted from the electronic tone generator 301 and the audio signal data loaded from the compact disk 402 are outputted so as to be delayed by that certain period of time in the DSP 10, the sound production based on the musical tone data and the audio signal data, and the sound production of the string struck by a solenoid on the automatic piano player side can be simultaneously made. By the arrangement of this embodiment, even when musical performance information having a high density is inputted, the pointer can be prevented from overtaking to overflow data as stated earlier since the DSP 10 provides delayed output with the musical tone data and the audio signal data therein. As a result, there is offered an advantage in that a proper ensemble performance is provided.

The musical performance control method, the musical performance control apparatus and the musical tone generating apparatus according to the present invention are not limited to the embodiments stated earlier. Various modifications are of course possible without departing the sprit of the invention.

What is claimed is:

1. A musical performance control method comprising:

providing a first automatic performance part based on musical performance information;

generating musical tone data from the musical performance information;

writing the musical tone data to a memory;

reading the musical tone data from the memory after a set period of time has passed to provide a delay to a second automatic performance part; and providing the second automatic performance part outputted as the musical tone data as an ensemble performance such that the second automatic performance part synchronizes with the first automatic performance part.

2. The musical performance control method according to claim 1, wherein the second automatic performance part is subjected to data processing by a digital signal processor, causing the second automatic performance part to be outputted with the delay.

3. The musical performance control method according to claim 1, wherein the first automatic performance part is an automatic piano player part.

4. The musical performance control method according to claim 1, wherein the delay is automatically set with respect to a delay output of the musical tone data.

5. A musical performance control method comprising:

providing a first automatic performance part based on musical performance information;

generating musical tone data from the musical performance information;

writing the musical tone data to a memory;

reading the musical tone data from the memory after a set period of time has passed to provide a delay to a second automatic performance part; and providing the second automatic performance part outputted as the musical tone data including audio signal data as an ensemble performance such that the second automatic performance part synchronizes with the first automatic performance part.

6. A musical performance control apparatus, which provides a first automatic performance part based on musical performance information and a second automatic performance part outputted as musical tone data as an ensemble performance, comprising:

a processing path for the second automatic performance part; and a signal processing unit in the processing path configured to write the musical tone data to a memory, and read the musical tone data from the memory after a set period of time has passed to provide a delay to the second automatic performance part so that the second automatic performance part synchronizes with the first automatic performance part.

7. The musical performance control apparatus according to claim 6, wherein the signal processing unit comprises a digital signal processor.

8. The musical performance control apparatus according to claim 6, wherein the first automatic performance part is an automatic piano player part.

9. The musical performance control apparatus according to claim 6, wherein the delay is automatically set with respect to a delay output of the musical tone data.

10. A musical performance control apparatus, which provides a first automatic performance part based on musical performance information and a second automatic performance part outputted as musical tone data including audio signal data as an ensemble performance, comprising:

a processing path for the second automatic performance part; and a signal processing unit in the processing path configured to write the musical tone data to a memory, and read the musical tone data from the memory after a set period of time has passed to provide a delay to the second automatic performance part so that the second automatic performance part synchronizes with the first automatic performance part.

11. A tone generating apparatus comprising:

an electronic tone generator configured to output musical tone data;

an external automatic performance apparatus configured to provide an automatic performance part;

a controller configured to produce a delay time; and a signal processing unit configured to write musical tone data to a memory, accept the delay time from the controller, read the musical tone data from the memory after the delay time has passed to provide a delay to the musical tone data, and add a predetermined acoustic effect to the musical tone data, wherein the signal processing unit outputs the musical tone data with a delay such that the musical tone data outputted from the electronic tone generator synchronizes with the automatic performance part provided by the external automatic performance apparatus.

* * * * *

UNITED STATES PATENT AND TRADEMARK OFFICE

CERTIFICATE OF CORRECTION

PATENT NO. : 6,750,389 B2
DATED : June 15, 2004
INVENTOR(S) : Yutaka Hagiwara et al.

It is certified that error appears in the above-identified patent and that said Letters Patent is hereby corrected as shown below:

Column 4,
Line 49, delete “is”;

Column 6,
Line 48, delete “is”;

Column 14,
Line 36, change “pervious” to -- previous --; and
Line 55, change “sprit” to -- spirit --.

Signed and Sealed this

Fourth Day of January, 2005

JON W. DUDAS
*Director of the United States Patent and Trademark Office*